US008622054B1

(12) United States Patent
Grace et al.

(10) Patent No.: US 8,622,054 B1
(45) Date of Patent: Jan. 7, 2014

(54) METHODS AND SYSTEMS FOR REDUCING COMBUSTION EMISSIONS

(75) Inventors: Lance C. Grace, Alamogordo, NM (US); R. Craig Sparling, Cloudcroft, NM (US); Ronald E. Allred, Albuquerque, NM (US)

(73) Assignee: Clear Skies Unlimited, Inc., Albuquerque, NM (US)

( * ) Notice: Subject to any disclaimer, the term of this patent is extended or adjusted under 35 U.S.C. 154(b) by 1670 days.

(21) Appl. No.: 12/047,995

(22) Filed: Mar. 13, 2008

Related U.S. Application Data

(60) Provisional application No. 60/894,634, filed on Mar. 13, 2007.

(51) Int. Cl.
*F24B 1/18* (2006.01)

(52) U.S. Cl.
USPC ..... 126/500

(58) Field of Classification Search
USPC ..... 126/500, 507, 520, 552, 553, 126/299 R–299 F; 110/163
See application file for complete search history.

(56) References Cited

U.S. PATENT DOCUMENTS

| | | | | |
|---|---|---|---|---|
| 2,658,742 | A | 11/1953 | Suter et al. | |
| 3,691,346 | A | 9/1972 | Dyre et al. | |
| 3,998,758 | A | 12/1976 | Clyde | |
| 4,054,418 | A | 10/1977 | Miller et al. | |
| 4,164,931 | A * | 8/1979 | Jenkins | 126/553 |
| 4,225,561 | A | 9/1980 | Torres | |
| 4,373,452 | A | 2/1983 | Van Dewoestine | |
| 4,422,437 | A | 12/1983 | Hirschey | |
| 4,426,320 | A | 1/1984 | Ernest et al. | |
| 4,494,525 | A | 1/1985 | Albertsen | |
| 4,549,399 | A | 10/1985 | Usui et al. | |
| 4,557,250 | A | 12/1985 | Kramert | |
| 4,643,862 | A * | 2/1987 | Callahan | 264/133 |
| 4,744,216 | A | 5/1988 | Rao et al. | |
| 4,844,051 | A | 7/1989 | Horkey | |
| 5,082,172 | A * | 1/1992 | Karabin et al. | 236/1 G |
| 5,158,448 | A | 10/1992 | Kawasaki et al. | |
| 5,566,667 | A * | 10/1996 | Cox | 126/507 |
| 5,599,456 | A | 2/1997 | Fanning | |
| 5,701,882 | A | 12/1997 | Champion | |
| 5,759,400 | A | 6/1998 | Fanning | |
| 5,934,268 | A * | 8/1999 | Onocki | 126/512 |
| 6,237,587 | B1 * | 5/2001 | Sparling et al. | 126/500 |
| 2008/0072893 | A1 * | 3/2008 | Berry et al. | 126/500 |

* cited by examiner

*Primary Examiner* — Thomas Denion
*Assistant Examiner* — Daniel Bernstein
(74) *Attorney, Agent, or Firm* — Deborah A. Peacock; Justin R. Jackson; Peacock Myers, P.C.

(57) ABSTRACT

Methods and systems for reducing combustion emissions generated in, or released from, a combustion chamber are provided. Systems and methods provided herein may be used to modify, for example, an existing fireplace such that combustion emissions resulting from burning a fuel combustion source are reduced. The method involves providing an emission reduction system which includes a casing assembly with at least one panel of a catalyst-coated media and a support structure supporting the casing assembly. The casing assembly is positioned between a fuel combustion source and a flue by associating the support structure with an interior surface of the firebox. The fuel combustion source is burned to create a fire, such that the catalyst-coated media reduces emissions associated with fuel combustion when contacted with combustion exhaust.

51 Claims, 18 Drawing Sheets

METHODS AND SYSTEMS FOR REDUCING COMBUSTION EMISSIONS

RELATED APPLICATION INFORMATION

This application claims priority to U.S. Provisional Application No. 60/894,634 filed on Mar. 13, 2007. Accordingly, this application incorporates by reference in its entirety all subject matter of the above-referenced application to the extent such subject matter is not inconsistent herewith.

TECHNICAL FIELD

Methods and systems for reducing combustion emissions generated in, or released from, a combustion chamber are provided. Systems and methods provided herein may be used to modify, for example, an existing fireplace such that combustion emissions resulting from burning a fuel combustion source are reduced.

BACKGROUND

Fireplaces, particularly wood burning fireplaces, have been a staple of society for centuries, and are a nearly universally popular means for providing warmth to buildings, such as homes, hotels, and restaurants. A recent U.S. Census survey showed that more than 64,000,000 fireplaces have been installed in homes nationwide. A fireplace is the third most popular option for a new house, outranked only by central heating/air conditioning and a two-car garage. The National Association of Realtors says the addition of a fireplace is one of the best returns on investment a homeowner can make. Fireplaces are also increasingly becoming popular for use in outdoor settings like patios, decks, and balconies.

Fireplaces, however, are also known to be relatively inefficient at heating. Common fireplaces at best are only 15%-20% efficient at generating heat. In fact, during some stages of a fire's life, more energy, like the heat in warm air, is taken from the area surrounding the fireplace than is released by the fire itself. Furthermore, cold air from outdoors can enter indoor rooms via the fireplace, making these rooms even colder. With such inefficient heating, users of fireplaces often must stay huddled close to the fire and/or use additional sources of heat to keep warm.

In addition to being inefficient, fireplaces can cause, for example, harmful pollutants including particulates, volatile organic compounds ("VOCs"), and carbon monoxide to be emitted into the atmosphere. These emissions have been linked to adverse health effects, such as lung cancer, and environmental problems like smog and acid rain. Recognizing the environmental problems burning wood can exasperate, the United States Environmental Protection Agency ("EPA") has placed strict limits on the emissions permitted by wood burning stoves. The limits are currently 7.5 grams of smoke per hour (g/h) for non-catalytic stoves, and 4.1 g/h for catalytic stoves. The EPA is currently instituting new regulations regarding the use of wood burning fireplaces in the U.S. These regulations (e.g., ASTM E06.54) generally limit a fireplace to the release of about 5.1 g of particulates per kg of material burned. To date, no known solutions have been proposed for traditional fireplaces to meet these regulations. Accordingly, devices and methods for reducing combustion emissions generated in, or released from, a combustion chamber are needed.

SUMMARY

In some embodiments methods for reducing fuel combustion emissions associated with a firebox are provided. The methods include providing an emission reduction system. In some embodiments the system includes a casing assembly comprising at least one panel of a catalyst-coated media. The system further includes a support structure supporting the casing assembly. In general the support structure positions the casing assembly between a fuel combustion source and a flue. The support structure may be detachably associated with the interior of the firebox. When the fuel combustion source is burned to create a fire, the media reduces emissions associated with fuel combustion when contacted with the combustion exhaust.

In some embodiments the casing assembly is further substantially non-parallel and substantially non-perpendicular to the flow of the combustion exhaust.

In some embodiments the casing assembly is positioned substantially over the fuel combustion source to facilitate the transfer of infrared energy released by the fuel combustion out of the firebox.

In general the methods provided herein reduce emissions by reducing VOCs, particulates, or carbon monoxide in the exhaust, or any combination thereof.

In some embodiments the methods provided herein utilize a system that includes a support structure having a suspension element joined to the casing assembly. The suspension element includes fasteners for detachably-fastening the casing assembly to at least one wall of the firebox or the top of the firebox, or at least one wall and top of the firebox. In other embodiments the support structure includes at least one substantially vertical element having a first end in contact with the hearth of the firebox and a second end joined to the casing assembly. The support structure may be positioned substantially at the back of the interior of the firebox.

In some embodiments the methods provided herein utilize a system that includes a support structure having a plurality of substantially vertical elements positioned substantially at the back of the interior of the firebox, substantially at the sides of the interior of the firebox, or any combination thereof. In other embodiments the support structure further includes at least one substantially horizontal element joined to the second end, wherein the substantially horizontal element further supports the casing assembly.

In some embodiments the support structure further includes support structure adjusting elements suitable for adjusting the position of the casing assembly in relation to the combustion source.

In some embodiments the methods provided herein utilize a system that includes a casing assembly having a plurality of panels of a catalyst-coated media. In other embodiments the casing assembly further includes casing assembly adjusting elements suitable for adjusting the size of the casing assembly in relation to the number and size of the panels of a catalyst-coated media.

In some embodiments the methods provided herein utilize a system that includes a support structure detachably associated with the interior of the firebox by mechanisms selected from the group consisting of fasteners, friction, mounting brackets and adhesives.

In some embodiments a method for retrofitting a firebox is provided. The method includes inserting into the firebox an emission reduction system as provided herein.

In some embodiments a method provided herein further includes, prior to insertion of the system, measuring the dimensions of the interior of the firebox and modifying the dimensions of the system to conform with the dimensions of the firebox.

In other embodiments emission reduction systems are provided. A system includes a casing assembly comprising at least one panel of a catalyst-coated media. In general the media reduces emissions associated with fuel combustion when contacted with the combustion exhaust. A system also includes a support structure supporting the casing assembly. The support structure positions the casing assembly between a fuel combustion source and a flue. In general the support structure is detachably associated with the interior of the firebox. In some embodiments the casing assembly is substantially non-parallel and substantially non-perpendicular to the flow of the combustion exhaust. In some embodiments the casing assembly is positioned substantially over the fuel combustion source to facilitate the transfer of infrared energy released by the fuel combustion out of the firebox.

In some embodiments methods for retrofitting a firebox with an emission reduction system are provided. The methods may include providing an existing firebox and providing an emission reduction system as described herein. In various embodiments the emission reduction system is inserted into the existing firebox. In some embodiments the method further includes determining the approximate dimensions of the interior of an existing firebox and modifying the dimensions of the emission reduction system to correspond to the approximate dimensions of the firebox.

The foregoing summary is illustrative only and is not intended to be in any way limiting. In addition to the illustrative aspects, embodiments, and features described above, further aspects, embodiments, and features will become apparent by reference to the figures and the following detailed description.

BRIEF DESCRIPTION OF THE DRAWINGS

For a more complete understanding of embodiments of the present invention, the objects and advantages thereof, reference is now made to the following descriptions taken in connection with the accompanying drawings in which.

Figure 1:
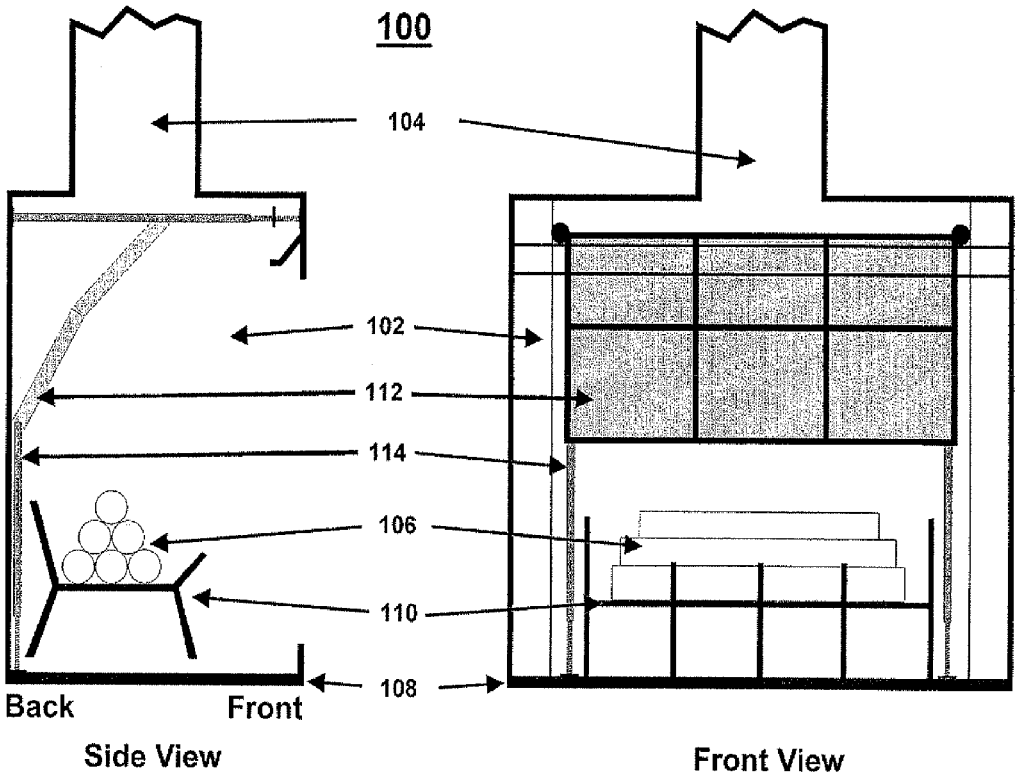
FIG. 1 illustrates a fireplace from a side and front view.

Corresponding reference characters indicate corresponding components throughout the several views of the drawings. One of ordinary skill in the art will appreciate that elements in the figures are illustrated for simplicity and clarity and have not necessarily been drawn to scale. For example, the dimensions, sizing, and/or relative placement of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. It will also be understood that the terms and expressions used herein have the ordinary meaning as is usually accorded to such terms and expressions by those of ordinary skill in the corresponding respective areas of inquiry and study except where other specific meanings have otherwise been set forth herein.

DETAILED DESCRIPTION

The following description is not to be taken in a limiting sense, but is made merely for the purpose of describing the general principles of the invention. The scope of the invention should be determined with reference to the claims. The present embodiments address the problems described in the background while also addressing other additional problems as will be seen from the following detailed description.

Referring now to FIG. 1, depicted is a fireplace 100 from a side and front view according to an embodiment of the invention. The fireplace 100 is any architectural element comprising a combustion chamber designed to contain a fire. The fireplace 100 can be, for example, a traditional brick or stone masonry fireplace, a metal prefabricated fireplace, a wood burning stove, or a gas fireplace. In other embodiments, the fireplace 100 is an item designed for industrial use, such as an industrial furnace. The fireplace 100 can be pre-fabricated or built in place. The fireplace 100 comprises a firebox 102 in communication with a flue 104.

The firebox 102 is a region of the fireplace 100 where a fuel combustion source 106 is positioned and ignited to create a fire. The firebox 102 can be made from masonry, concrete, brick, stone, iron, ceramic, or any other material(s) suitable for withstanding the high temperatures associated fires, which can reach 1800° F. in typical household applications. Much higher temperatures can be encountered in industrial applications, and temperatures up to 4000° F. or more are possible. Those of ordinary skill in the art will recognize that the specific material(s) used for the firebox 102 will be dictated by the intended use of the fireplace 100. In some embodiments, the firebox 102 further comprises a hearth 108 that defines a bottom portion of the firebox 102. The hearth 108, in some embodiments of the invention, is made from any of the materials suitable for creating the firebox 102, and can also comprise other materials, such as decorative materials like marble, granite, or slate.

The fuel combustion source 106 is any substance suitable for controlled combustion, such as organic matter and natural gases. Example materials comprising organic matter include wood, manufactured wax or sawdust firelogs, paper, and charcoal. Possible natural gases include, for example, methane, propane, and ethane. In some embodiments, the fuel combustion source 106 is positioned directly on top of the hearth 108 to be burned, while in other embodiments the fuel combustion source 106 is placed in a grate 110, which facilitates airflow around the fuel combustion source 106 necessary for combustion. Where the fuel combustion source 106 comprises natural gas, using methods well known to those skilled in the art, a finite amount of gas is continuously released into the firebox 102 for immediate combustion.

According to one embodiment methods for reducing fuel combustion emissions from a fuel combustion source associated with a firebox are provided. The methods include providing an emission reduction system and inserting the system in to a firebox. In some embodiments the system includes a casing assembly comprising at least one panel of a catalyst-coated media. In general the media reduces emissions associated with fuel combustion when contacted with the combustion exhaust. The system further includes a support structure supporting the casing assembly. In general the support structure positions the casing assembly between a fuel combustion source and a flue. The support structure may be detachably associated with the interior of the firebox.

Referring to FIG. 1 an emission reduction system includes a casing assembly (see element 202 of FIG. 2) comprising at least one panel of a catalyst-coated media 112. In general the media reduces emissions associated with fuel combustion when contacted with the combustion exhaust. A system further includes a support structure 114 supporting the casing assembly (see element 202 of FIG. 2). In general the support structure positions the casing assembly between a fuel combustion source and a flue. The support structure may be detachably associated with the interior of the firebox. For example, in some embodiments the methods provided herein utilize a system that includes a support structure having a suspension element joined to the casing assembly. The suspension element includes fasteners for detachably-fastening the casing assembly to at least one wall of the firebox or the top of the firebox, or at least one wall and top of the firebox. In other embodiments the support structure includes at least one substantially vertical element having a first end in contact with the hearth of the firebox and a second end joined to the casing assembly. The support structure may be positioned substantially at the back of the interior of the firebox.

In other embodiments, a system provided herein includes a support structure having a plurality of substantially vertical elements positioned substantially at the back of the interior of the firebox, substantially at the sides of the interior of the firebox, or any combination thereof. In other embodiments the support structure further includes at least one substantially horizontal element joined to the second end, wherein the substantially horizontal element further supports the casing assembly. In some embodiments the support structure further includes support structure adjusting elements suitable for adjusting the position of the casing assembly in relation to the combustion source.

Referring again to FIG. 1, the media 112, in some embodiments, is made from ceramic, metal, or a similar material. The size and shape of the media 112 is dictated by its use. For instance, when used in a fireplace 100, the size and shape of the firebox 102 the media 112 is placed in will generally constrain the size and shape of the media 112. For example, referring to FIG. 2, the media 112 may be divided into two pieces to permit the operation of a damper (not shown) by extending a damper handle (not shown) through the middle of the media 112 and a casing assembly 202, discussed in more detail below. The casing assembly 202 supporting the media 112 and the media 112 are sized to fit within a firebox (not shown) and sized to cover most if not all of the flue (not shown).

According to another embodiment the media 112 is coated with a catalyst. In some embodiments the catalyst includes a transition metal, such as platinum, palladium, or rhodium, or combinations thereof. In other embodiments, the catalyst comprises any other material that promotes efficient and rapid oxidation of carbon and hydrocarbons, such as ceria or titanium dioxide. Additional catalysts can also be used, such as mixtures of catalysts, or low temperature catalysts and non-ionizing radiation activated catalysts for use during low temperature periods, for instance when the temperature of the catalyst is below 350° F. One of ordinary skill in the art will recognize that the specific catalyst(s) to be used will depend on the content of the exhaust to be cleaned, to be discussed in more detail below.

Figure 2:
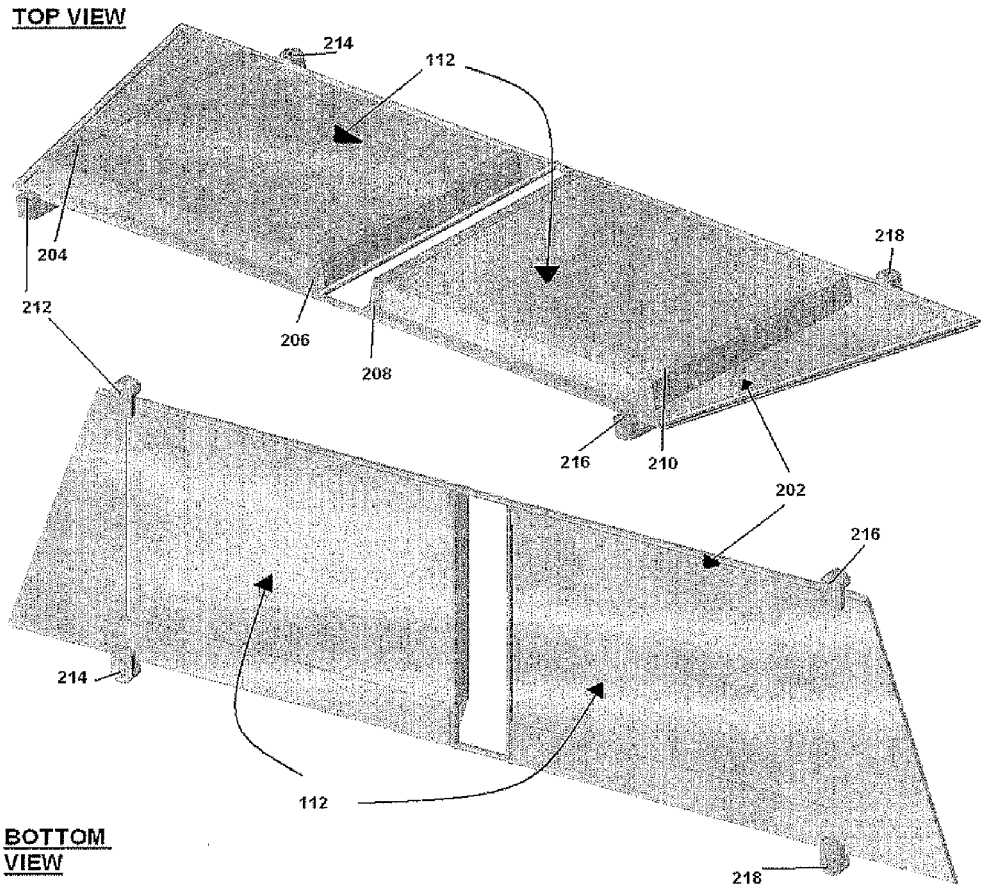
FIG. 2 depicts a frame supporting a media from a top and bottom view.

In some embodiments, a casing assembly includes at least one panel of media 112 comprises an open-celled or reticulated structure. In other embodiments a casing assembly can include a plurality of panels. For example, FIG. 2 depicts two panels of media 112 associated with a casing assembly 202. It is understood that a casing assembly can include any number of panels in any configuration suitable for use in a method for reducing fuel combustion emissions associated with a firebox as described herein. As is well known to those skilled in the art, a reticulated structure is a three-dimensional latticework of interconnected ligaments that form a porous, open structure. A reticulated structure has a high internal surface area per structure volume, and appears somewhat like a sponge. Unlike a reticulated structure, open-celled structures ("foams") comprise a plurality of open and closed cells, but can be engineered to exhibit properties similar to reticulated structures. In some embodiments, the catalyst of the media 112 coats all the internal surfaces of the media 112. In some embodiments the casing assembly is positioned to be substantially non-parallel and substantially non-perpendicular to the flow of the combustion exhaust. In some embodiments the casing assembly is positioned substantially over the fuel combustion source to facilitate the transfer of infrared energy released by the fuel combustion out of the firebox. In general the methods provided herein reduce emissions by reducing particulates, VOCs, or carbon monoxide in the exhaust, or any combination thereof.

Figure 3:
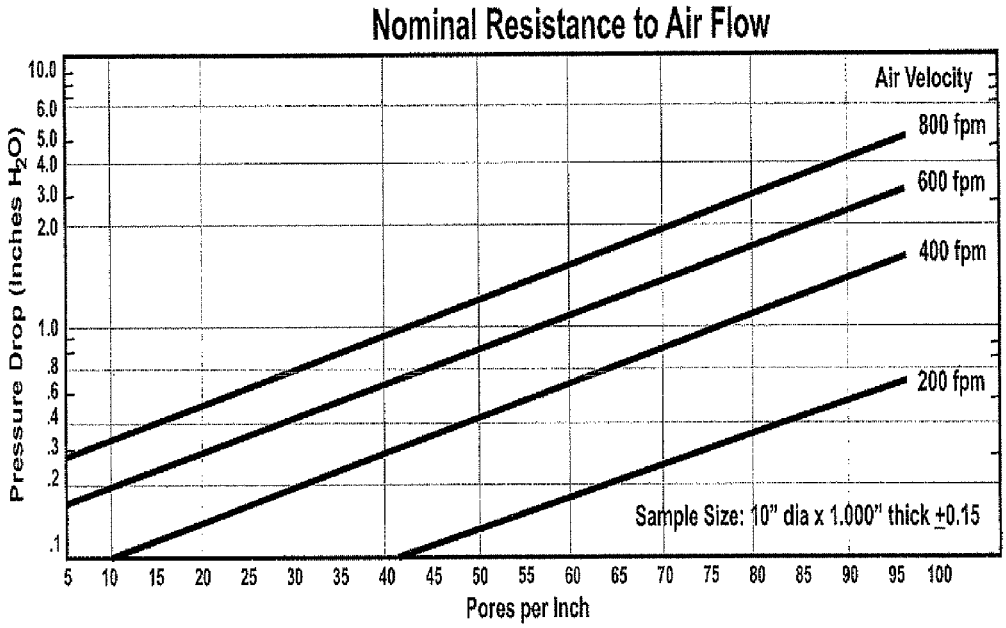
FIG. 3 depicts a graph of pressure drops versus pores per linear inch for various air velocities for typical reticulated structures.

Referring again to FIG. 1, pore dimensions of the media 112, in some embodiments, are kept at a relatively constant size throughout the media 112. The pore dimension of the media 112 can vary from approximately 0.02 to 0.33 inches, depending on the specific application. More specifically, the pore dimension selected for a specific media 112 depends on the material used to create the media 112, and is selected to provide a low back pressure to fluid flow within the firebox 102 while also providing for the turbulent flow needed to obtain adequate contact between the catalytic surfaces of the media 112 and the fluid, in this case the exhaust gases of the fire in the fireplace 100. Maintaining a low back pressure to fluid flow is necessary to ensure exhaust gases flow through the media 112 to the flue 104 rather than through the front of the firebox 102. If the back pressure of the media 112, caused by an accumulation of particles in the media 112 and/or the pore density of the media 112, drops the differential draft pressure in the firebox 102 below that of the flue 104, then the exhaust will flow out the front of the firebox 102 rather than through the flue 104. Since, in some embodiments, most if not all particulates in the fire exhaust are either immediately combusted by or pass through the media 112, pressure drops versus pores per linear inch for various air velocities for typical reticulated structures are provided in FIG. 3 and can significantly aid in the selection of a media 112 for a specific application.

As discussed above, the pores in the media 112 also provide turbulent flow within the media 112. Turbulent flow refers to the tumbling and mixing of air. This tumbling ensures the contents of the fire exhaust continuously encounter the catalyst coating on the media 112 and the internal surfaces thereof. Turbulent flow therefore provides much higher contact between any pollutants in the exhaust and the catalyst, resulting in better heating efficiency and fewer pollutants released into the atmosphere, to be discussed in more detail below.

Referring back to FIG. 1, the media 112 is positioned in the firebox 102 such that hot exhaust gases resulting from burning the fuel combustion source 106 will flow through the media 112. In some embodiments, the media 112 is positioned in the firebox 102 to cause little to no effect on the fireplace 100 draft, even during startup when there is low fluid flow due to the low temperature of the fire. This is due to the combination of the extremely low resistance to airflow through the media 112, as discussed above, and the ability of an exhaust draft to simply flow around the media 112 and its supporting means, discussed in more detail below, during startup and other periods of low exhaust flow. Such fluid flow is accomplished, in some embodiments, because the means for supporting the media 112 are designed to position the media 112 in a manner such that it does not completely block the airflow path from the location of the fuel combustion source 106 to the flue 104. Thus, during high flow periods, the inertia of the exhaust will cause it to primarily flow through the media 112 due to its placement directly in the path of the flow. During low flow periods, however, the low inertia of the exhaust permits it to partially flow around the media 112 and directly into the flue 104.

Substances in the exhaust gases flowing through the media 112 can include, for example, carbon particulates, volatile organic compounds ("VOCs"), and carbon monoxide. When these substances come in contact with the catalyst on the media 112, carbon monoxide is oxidized to carbon dioxide and carbon and hydrocarbons are oxidized to carbon dioxide and water. These chemical reactions reduce the particulate emissions of the fireplace 100 to a level below the new United States Environmental Protection Agency ("EPA") regulations for wood burning fireplaces. In addition, these chemical reactions are exothermic and release heat energy. For example, in one embodiment, where the media 112 has a sufficient source of fuel 106, the media 112 increases in temperature up to or above 1200° F. In some embodiments, this released energy is transferred out from the fireplace 100 into the room in which the fireplace is located, increasing the efficiency of the fireplace 100. More detailed methods regarding how this heat is transferred are discussed in more detail below.

In some embodiments, the media 112, regardless of its pore dimension or catalyst coating, operates on any sized particulates. For example, the media 112 catalyzes and prevents the emissions of particulates that are smaller than 2.5 microns, which are produced by fireplaces and woodstoves, as well as in industrial applications.

Figure 4:
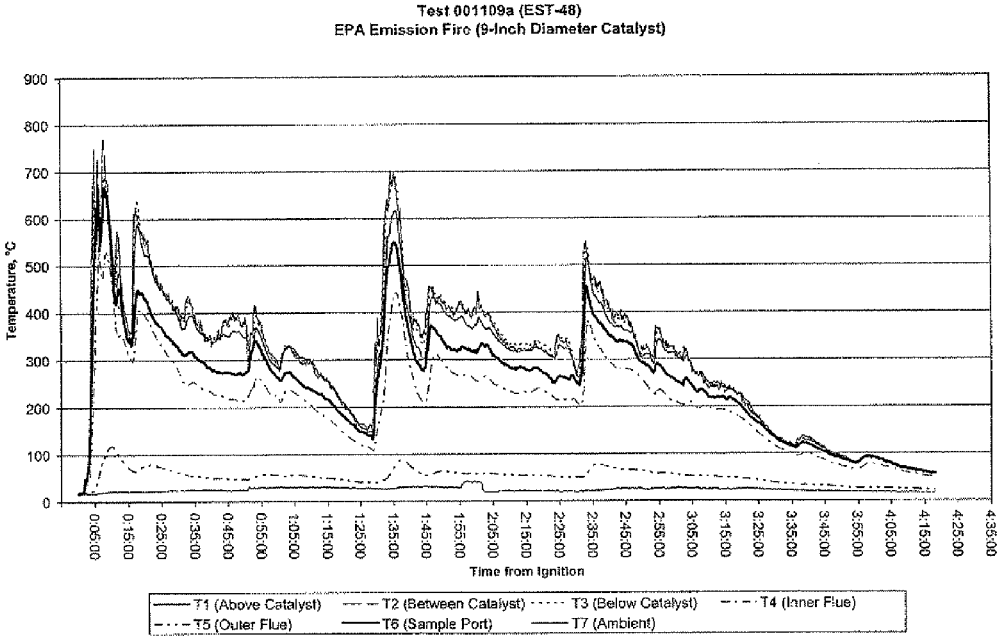
FIG. 4 illustrates a graph of fireplace test temperatures throughout a 4.25 hour burn.

In some embodiments of the invention, the media 112 removes between 50% and 90% of the pollutants it is exposed to, depending on the type of catalyst and the type of pollutants the media 112 is exposed to. In some embodiments, the catalytic efficiency of the media 112 varies depending on its temperature. For example, in one embodiment, the media 112 does not generally operate below 350° F., operates at a high efficiency, removing between 50% and 70% of the pollutants, between 700° F. and 800° F., and operates optimally, removing 80% to 90% or more of the pollutants, between 1200° F. and 1400° F. In some embodiments, the efficiency of the media 112 increases exponentially as the exhaust temperature of the fireplace 100 increases. Referring now to FIG. 4, depicted is a graph showing typical fireplace test temperatures throughout a 4.25 hour run. The fireplace has an average temperature of about 650° F. and a maximum temperature of about 1300° F. The efficiency of the media 112 will increase greatly as the fireplace is maintained at temperatures above 400° F. In the test run shown in FIG. 4 particulate emissions were 1.8 g per kg of fuel burned.

In some embodiments, because the exhaust produced in many applications is initially at ambient temperature and decreases in temperature as the fuel combustion source 106 is depleted, the media 112 may not operate efficiently, or at all. For this reason, in some embodiments of the invention, a heating element is added to the media 112 in order to bring it up to efficient operating temperatures, such as 350° F. to 400° F. The heating element can consist of a variety of designs and be powered by a variety of different energy sources. For example, in some embodiments, the heating element comprises an electrical coil or wires embedded within the media 112. In other embodiments, because the media 112 has a high resistance, the media 112 is directly coupled to an electrical source to cause the media 112 itself to heat. In some embodiments, the heating element is activated by flipping a switch. In other embodiments, a thermometer measures the temperature of the media 112 and automatically activates the heating element if the temperature of the media 112 falls below a set threshold, such as 400° F.

Referring back to FIG. 1, as discussed above, the media 112 is positioned in the firebox 102 such that hot exhaust gases resulting from burning the fuel combustion source 106 will flow through the media 112. In some embodiments, a support structure 114 is used to position and support the media 112 inside the firebox 102. The support structure 114 can be made of carbon steel, iron, stainless steel, ceramic material, or any other material or alloy capable of supporting the media 112 and withstanding the temperatures of the application. In the case of residential use, the support structure 114 should be capable of withstanding temperatures in excess of 1300° F., while industrial applications can be much higher. Those of ordinary skill in the art will recognize that the specific material(s) used for the support structure 114 will be dictated by the intended use of the fireplace 100. In residential applications, however, carbon steel and iron are particularly suited for forming the support structure 114 due to their low cost and durability.

The implementation of the support structure 114 can vary greatly, and the following descriptions should serve only as possible examples of the support structure 114 according to embodiments of the invention.

Figure 5:
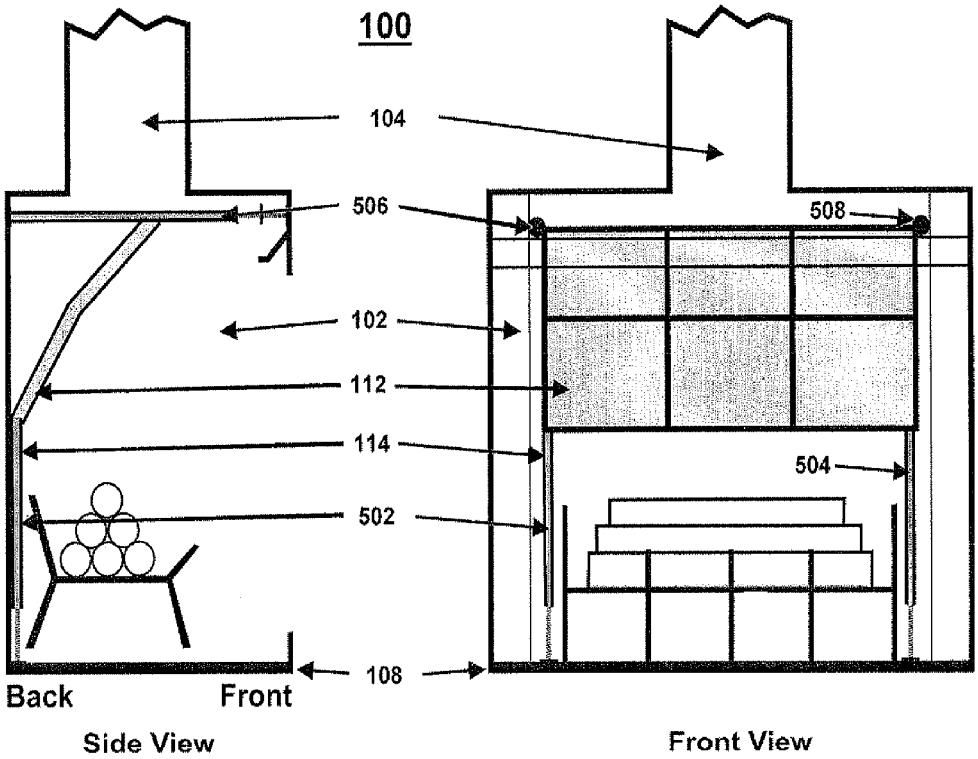
FIG. 5 depicts a support structure with two vertical members and two horizontal members from a side and front view.

Referring now to FIG. 5, the support structure 114 comprises two vertical members 502 and 504 attached to a bottom portion of the media 112 that are in contact with the hearth 108. The support structure 114 further comprises two horizontal members 506 and 508 that are attached to the media 112 and that extend from a back wall of the firebox 102 to a front of the firebox 102. Collectively, these members 502, 504, 506, and 508 maintain the media 112 in a position above the hearth 108, and restrict substantial movement of the media 112 in any direction.

Figure 6:
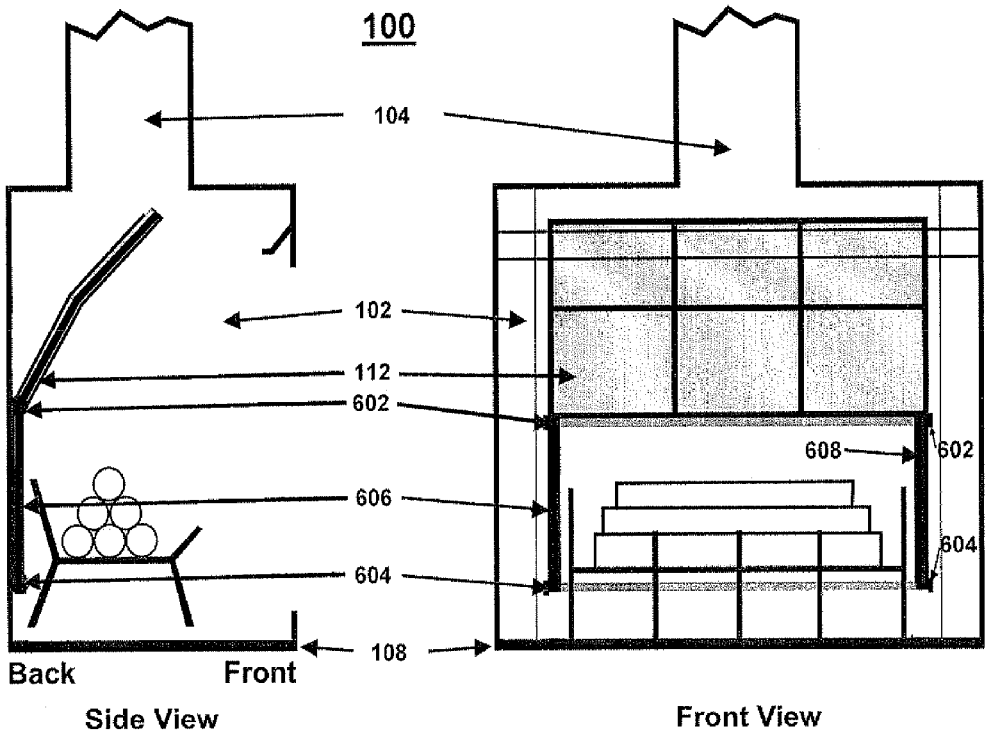
FIG. 6 depicts a support structure with two horizontal members attached to cantilevered arms from a side and front view.

Referring now to FIG. 6, the support structure 114 comprises two horizontal members 602 and 604 that extend from a first side wall of the firebox 102 to a second firewall of the firebox 102. These members are attached to two cantilevered arms 606 and 608. The cantilevered arms 606 and 608 in turn support the media 112 in a position above the hearth 108 and restrict substantial movement of the media 112 in any direction.

Figure 7:
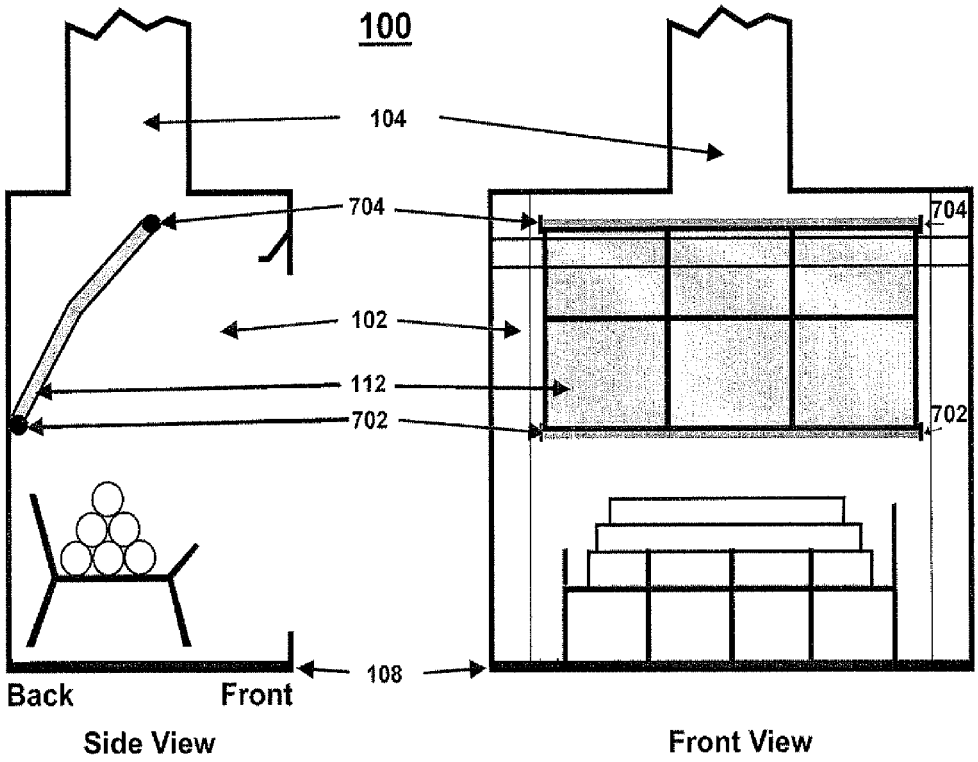
FIG. 7 depicts a support structure with two horizontal members from a side and front view.

Referring now to FIG. 7, the support structure 114 comprises two horizontal members 702 and 704 attached to the media 112 that extend from a first side wall of the firebox 102 to a second firewall of the firebox 102. The horizontal members 702 and 704 alone support the media 112 in a position above the hearth 108 and restrict substantial movement of the media 112 in any direction.

Figure 8:
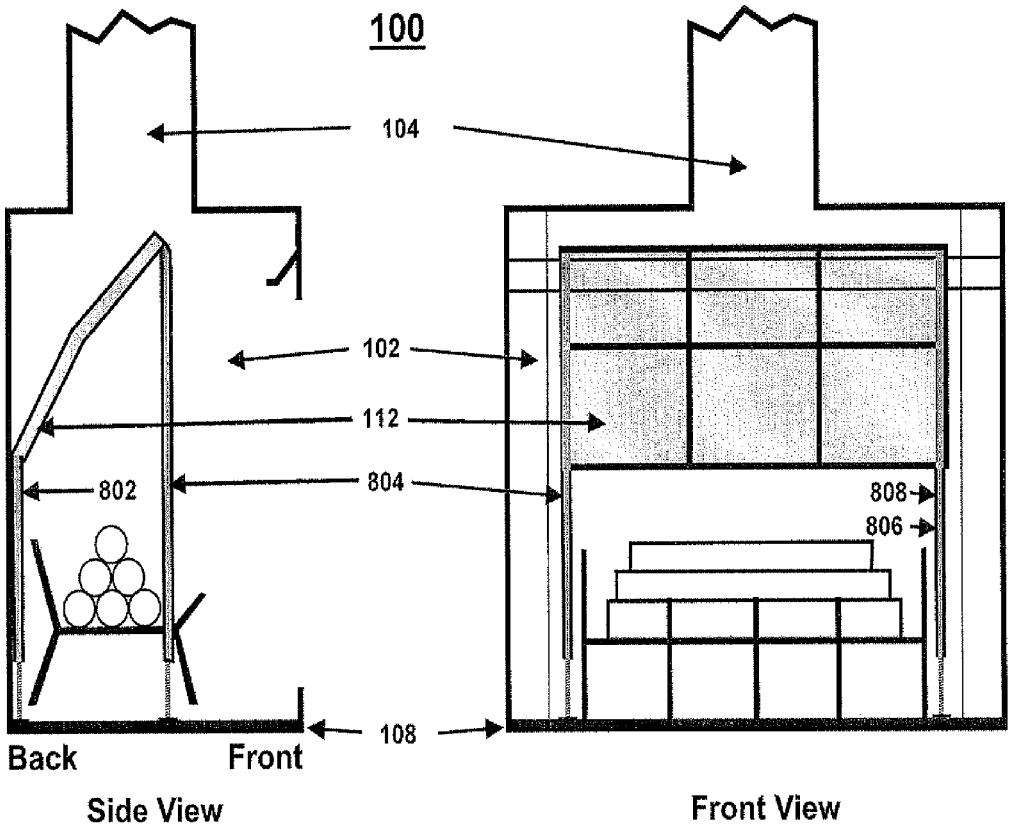
FIG. 8 depicts a support structure with four vertical members from a side and front view.

Referring now to FIG. 8, the support structure 114 comprises four vertical members 802, 804, 806, and 808 (not visible) attached to the media 112 that extend vertically from the hearth 108 and support the media 112 in a position above the hearth 108.

Figure 9:
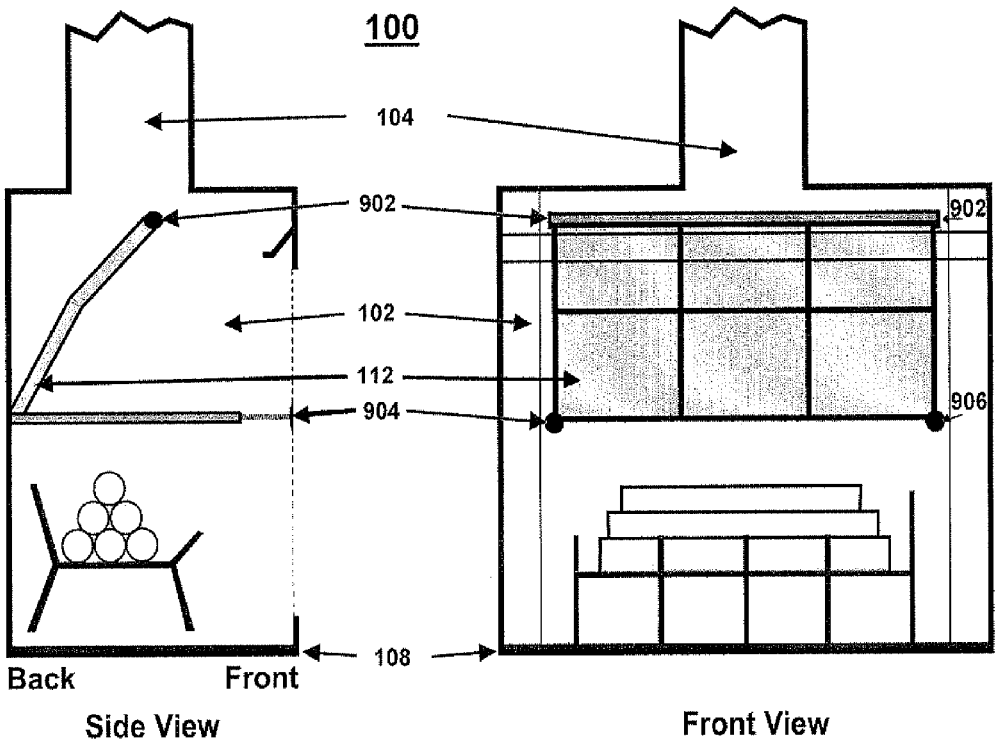
FIG. 9 depicts a support structure with a horizontal member and two horizontal members from a side and front view.

Referring now to FIG. 9, the support structure 114 comprises a horizontal member 902 attached to the media 112 extending horizontally from a first sidewall of the firebox 102 to a second sidewall of the firebox 102. The support structure 114 further comprises two horizontal members 904 and 906 that are attached to the media 112 and that extend from a back wall of the firebox 102 to a front of the firebox 102. Collectively, these members 902, 904, and 906 maintain the media 112 in a position above the hearth 108, and restrict substantial movement of the media 112 in any direction.

Figure 11:
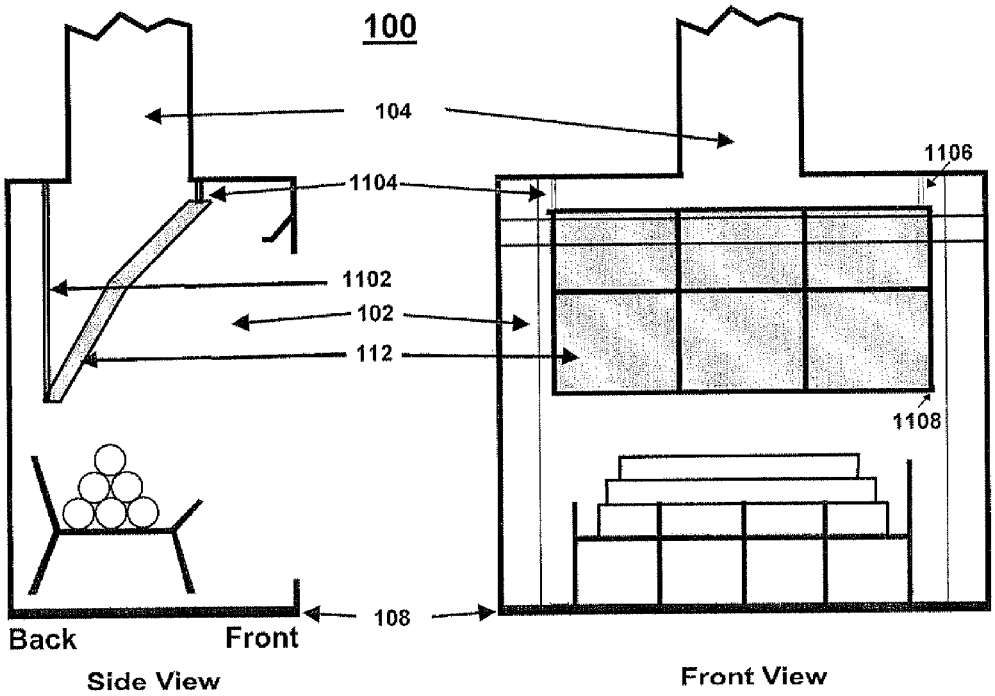
FIG. 11 illustrates a support structure with metal wires mounted to a top of a fireplace and suspending a media from a side and front view.

In some embodiments of the invention, the support structure 114 comprises metal wires, chains, or like items. These metal wires or chains, either mounted to the firebox 102 at the time of production, or secured to the firebox 102 using known methods, provide heat resistant anchor points on which the media 112 can be supported. As will be appreciated by those of ordinary skill in the art, there are numerous ways to utilize wires, chains, or like items to maintain the position of the media 112 in the firebox 102 above the fuel combustion source 106. For instance, in one embodiment, as depicted in FIG. 11, the support structure 114 comprises four metal wires 1102, 1104, 1106, and 1108 (not visible). These metal wires 1102, 1104, 1006, and 1008 are mounted to the top of the firebox 102 and are predetermined lengths. The media 112 is mounted to these wires 1102, 1104, 1106, 1108 (not visible) and is therefore suspended from a top of the firebox 102 and maintained in a position above the hearth 108.

Figure 12:
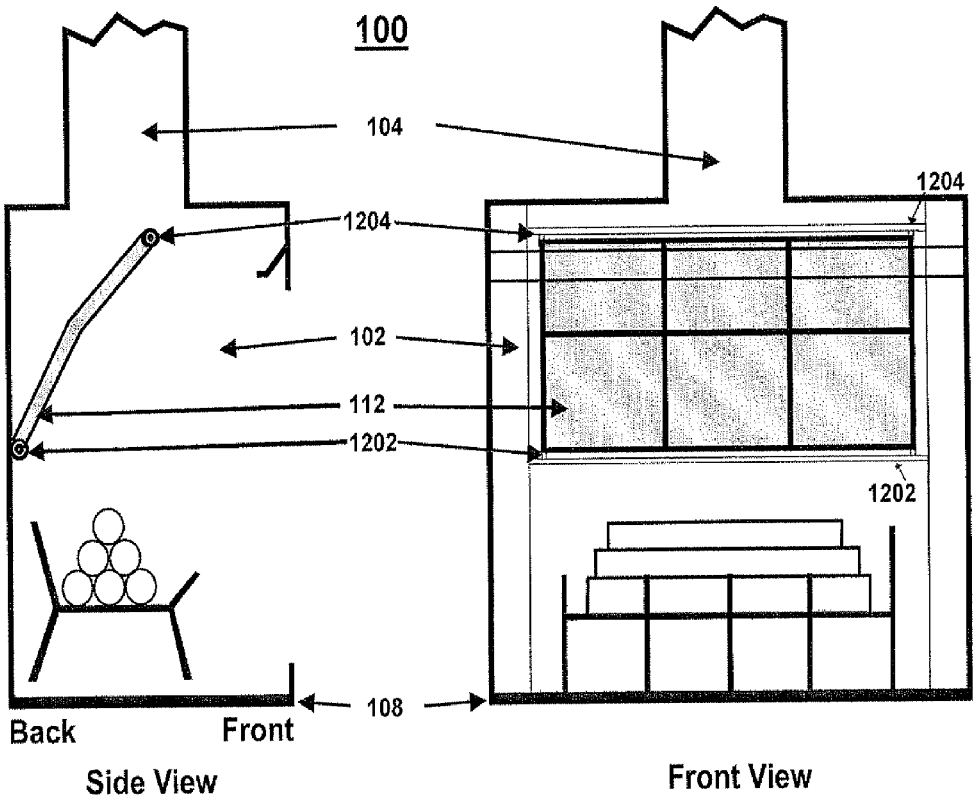
FIG. 12 depicts a support structure with two metal wires mounted to a fireplace and a media from a side and front view.

In another embodiment, as depicted in FIG. 12, the support structure 114 comprises two metal wires 1202 and 1204. These metal wires 1202 and 1204 are strung from one side of the firebox 102 to the other side and maintained at tension. The media 112 is mounted to these wires 1202 and 1204 and is maintained in a position above the hearth 108.

In some embodiments, the support structure 114 is free-standing. In other embodiments, the support structure is mounted or otherwise attached to the firebox 102. In these embodiments, the support structure 114 is attached to the firebox 102 using a variety of methods, such as utilizing mounting brackets in the firebox 102, attaching the support structure 114 to hard points in the firebox 102, or using heat resistant adhesive to adhere the support structure 114 to the firebox 102. In some embodiments, the support structure 114 is "built in" to the firebox 102 such that the support structure 114 is not removable or otherwise separate from the firebox 102. One skilled in the art will appreciate that such mounting permits the support structure 114 to be implemented in numerous variations, such as being built into or otherwise attached to a top of the firebox 102.

Figure 10:
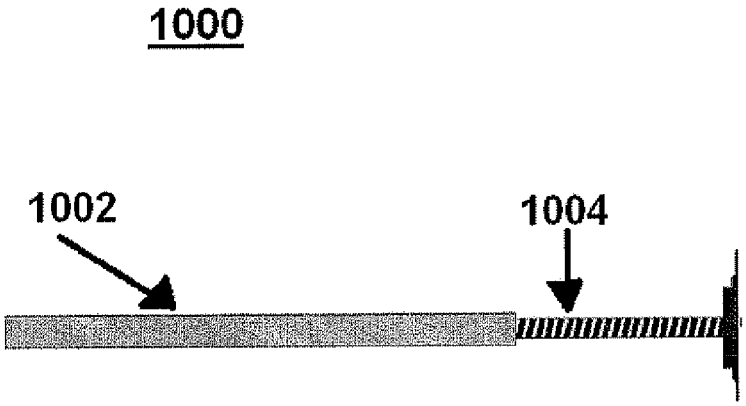
FIG. 10 depicts an adjustable threaded rod.

In some embodiments, the support structure 114 is specifically designed to fit within a particular firebox 102. In other embodiments, the support structure 114 is adjustable so that it can be adapted to fit a variety of different shaped fireplaces. For example, referring to FIG. 1 and FIG. 10, in one embodiment, the support structure 114 comprises one or more threaded rods 1000, well known to those or ordinary skill in the art, that can be adjusted as necessary by being twisted. Each threaded rod 1000 comprises a receptacle 1002 with internal threads and a leg 1004 with complementary external threads. When the threaded rod 1000 is twisted, the leg 1004 screws or unscrews into the receptacle 1002, thereby permitting the length of the rod 1000 to vary. By varying the length of the threaded rods 1000, a high degree of friction can be exerted on the surrounding firebox 102, thereby permitting the support structure 114 to be secured to the firebox 102 without any fixed attachments.

In another embodiment, the support structure 114 comprises one or more spring loaded rods (not shown), similar to a spring loaded shower curtain rod. Each spring loaded rod comprises a receptacle with an internal spring and a leg that slides into and out of the receptacle. As the leg slides into the receptacle, the spring is compressed, exerting force on the leg in outward manner. When the rods are inserted into the firebox 102, the rods are compressed to fit the internal dimensions of the firebox 102. The spring provides a high degree of friction between the support structure 114 and the firebox 102, thereby keeping the support structure 114 securely in place within the firebox 102.

The support structure 114 is attached to the media 112 in a variety of methods. In one embodiment, referring to FIG. 2, depicted are top and bottom views of the media 112 attached to a casing assembly 202. The casing assembly 202 is sized and shaped to couple with the media 112. The casing assembly 202 can be made of metal, carbon steel, iron, stainless steel, ceramic material, or any other material or alloy capable of supporting the media 112 and withstanding the temperatures of the application, as discussed in detail above. Those of ordinary skill in the art will recognize that the specific material(s) used for the casing assembly 202 will be dictated by the intended use of the fireplace 100.

As depicted in FIG. 2, in one embodiment, the edges of the media 112 are surrounded by the casing assembly 202. Bands 204, 206, 208, and 210 surround the casing assembly 202 and the media 112 and are used to mount the casing assembly 202 to the support structure (not shown) by means of bolts through bolt holes 212, 214, 216, and 218. In one embodiment, the bands 204, 206, 208, and 210 are made of stainless steel, though many other materials can be used. As discussed above, in some embodiments of the invention, the media 112 is divided into two pieces to permit the operation of a damper (not shown) by extending a damper handle (not shown) through the middle of the media 112 and the casing assembly 202. The casing assembly 202 is sized to fit snugly within a firebox (not shown) and sized to cover most if not all of the flue (not shown).

Other methods (not shown) for attaching the media 112 to the support structure 114, include, for example, utilizing wire to tie the media 112 or its casing assembly 202 to the support structure 114, clamping the media 112 or its casing assembly 202 to the support structure 114, utilizing steel clips fashioned on the end of the steel bands 204, 206, 208, and 210 to be mounted to the support structure 114, or utilizing heat-resistant adhesive to glue the media 112 or its casing assembly 202 to the support structure 114. Other methods of securing the media 112 to the support structure 114 will be readily apparent to one of ordinary skill in the art.

In some embodiments, the media 112 is removable from the support structure 114 for cleaning or replacement purposes. For instance, in one embodiment, the casing assembly 202 is made of two pieces that are held together by the bands 204, 206, 208, and 210. When the bolts through bolt holes 212, 214, 216, and 218 are disengaged from the support structure 114, the bands 204, 206, 208, and 210 no longer exert force on the casing assembly 202, causing the two pieces of the casing assembly 202 to separate, and allowing removal of the media 112 from the casing assembly 202. In another embodiment, as depicted in FIG. 2, merely disengaging the bands 204, 206, 208, and 210 from the support structure (not shown) will release the media 112 from the casing assembly 202. In another embodiment, when clamps are disengaged from the media 112 or its frame 202, the media 112 and/or its frame 202 will be released from the support structure 114 and the frame 202 will open, permitting removal of the media 112. In other embodiments, the media 112 is attached to the support structure 114 in a hinging manner such that the media 112 can be rotated closer or farther from the flue 106, facilitating easier access to the media 112 by a user. Other methods of securing the media 112 to the support structure 114 in a manner permitting the media 112 to be removable from the support structure 114 will be readily apparent to one of ordinary skill in the art.

As will be appreciated by those of ordinary skill in the art, the means for supporting the media 112, be it the support structure 114, a self-supporting media 112 (i.e. a media 112 and/or casing assembly 202 that is not mounted to a support structure 114, but rather directly mounted to the firebox 102), or like structures or methods, can be permanently or temporarily installed in the firebox 102. Furthermore, in other embodiments, no fireplace 100 or firebox 102 is needed at all, and the support structure 114 can be configured to simply support itself on the ground above any fuel combustion source 106. For instance, as depicted in FIG. 8, the support structure 114 comprising vertical members 802, 804, 806, and 808 can simply support itself on the ground above any fuel combustion source, such as at a camp fire or a fire on a beach. Likewise, because of the numerous mounting and installation techniques discussed and known to those of skill in the art, the media 112 can integrated into new fireplaces, or retrofitted to existing fireplaces.

As discussed above, the chemical reactions between the catalyst of the media 112 and pollutants release heat energy that can be transferred out from the fireplace 100 into the room in which the fireplace is located 100. Furthermore, the media 112 and the support structure 114 absorb energy from the fire and radiate that energy outward. Thus, in some embodiments of the invention, the media 112 is positioned to reflect and direct the infrared energy released by the bulk of the fire and by the exothermic reactions of the catalyst out of the fireplace 100 opening and into the room being heated, as depicted in FIG. 1. In other embodiments, the support structure 114 is likewise designed and positioned to optimize the amount energy reflected and radiated from the support structure 114 out of the fireplace 100. The radiative energy is then absorbed by items outside of the fireplace 100, such as walls, furniture, floor coverings, and people, thereby increasing the temperature of those items and increasing the efficiency of the fireplace 100.

In some embodiments of the invention, the media 112 is positioned at a selected angle that optimally reflects and directs the infrared energy released by the bulk of the fire and by the exothermic reactions of the catalyst out of the fireplace 100 opening and into the room being heated. The specific degree of the angle of the media 112 depends on several factors, including the height and position of the fire and the size and shape of the firebox 102. Angles from 0 to 65 degrees relative to a top of the firebox 102, however, have been found to be ideal for most consumer fireplace applications.

Figure 13:
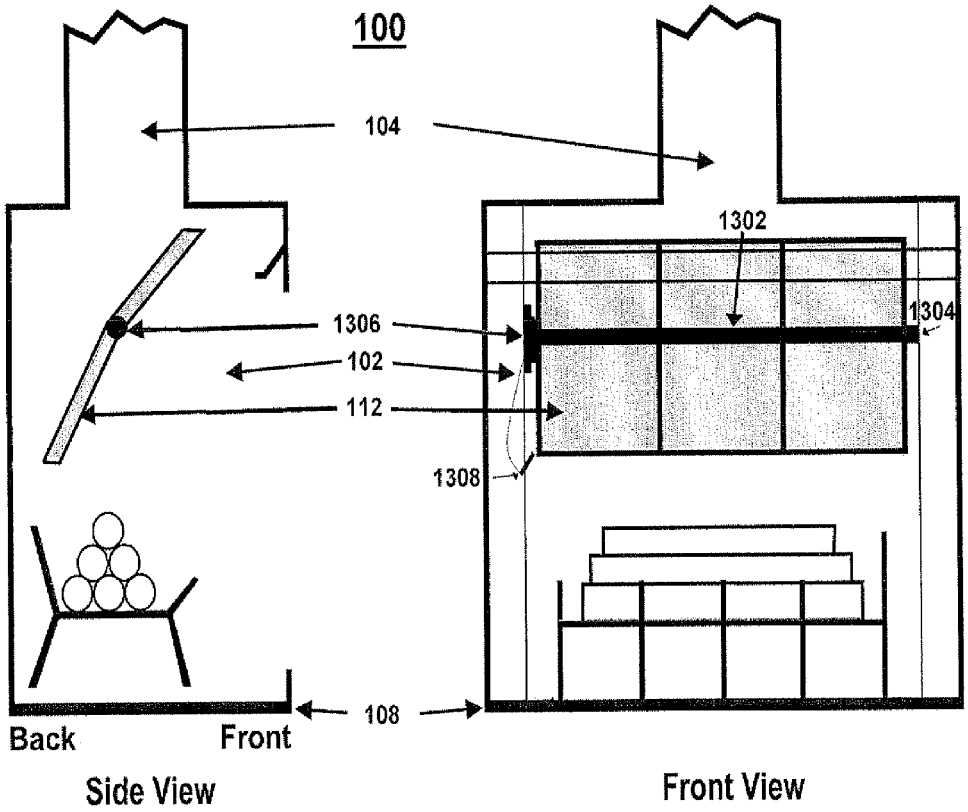
FIG. 13 illustrates a support structure in a fireplace mounted to a motor from a side and front view.

In some embodiments, the angle of the media 112 is adjusted to optimally reflect and direct energy into the room. For instance, where the media 112 is mounted using hinges or like devices to the support structure 114, the angle of the media 112 can be adjusted by rotating the media 112 on its hinges. Referring now to FIG. 13, in another embodiment, the support structure 114 can comprise a horizontal member 1302 attached to the media 112 and extending from a first side wall of the firebox 102 to a second side wall of the firebox 102. A first end of the member 1302 is pivotably engaged to the firebox 114 or a mounting device 1304, while a second end of the member 1302 is mounted to a motor 1306 coupled to the firebox 102. The motor 1306 is capable of rotating the member 1302, thereby adjusting the angle of the media 112. The motor receives feedback from a thermometer 1308 and corresponding electronics (not shown), and adjusts the angle of the media 112 to maximize the amount of heat energy projected from the media 112 into the room. In a similar embodiment, rather than using feedback from the thermometer 1308, the motor 1306 is controlled manually. For instance, the motor 1306 can be controlled by a wireless remote (not shown), or by a switch (not shown) wired to the motor 1306. An operator utilizes the remote or switch to control the motor 1306 and adjust the angle of the media 112 to obtain the desired amount of energy reflection and radiation.

In some embodiments, rather than using electronics, the angle of the media 112 is adjusted manually. For instance, instead of using a motor 1306 to adjust the angle of the media 112, the media 112 can be adjusted by using a fireplace tong (not shown) or similar device to rotate the media 112 into the desired position. In other embodiments, when the media 112 is cool to the touch, the media 112 can be rotated by hand. Other methods for changing the angle of the media will be apparent to those skilled in the art.

Figure 14:
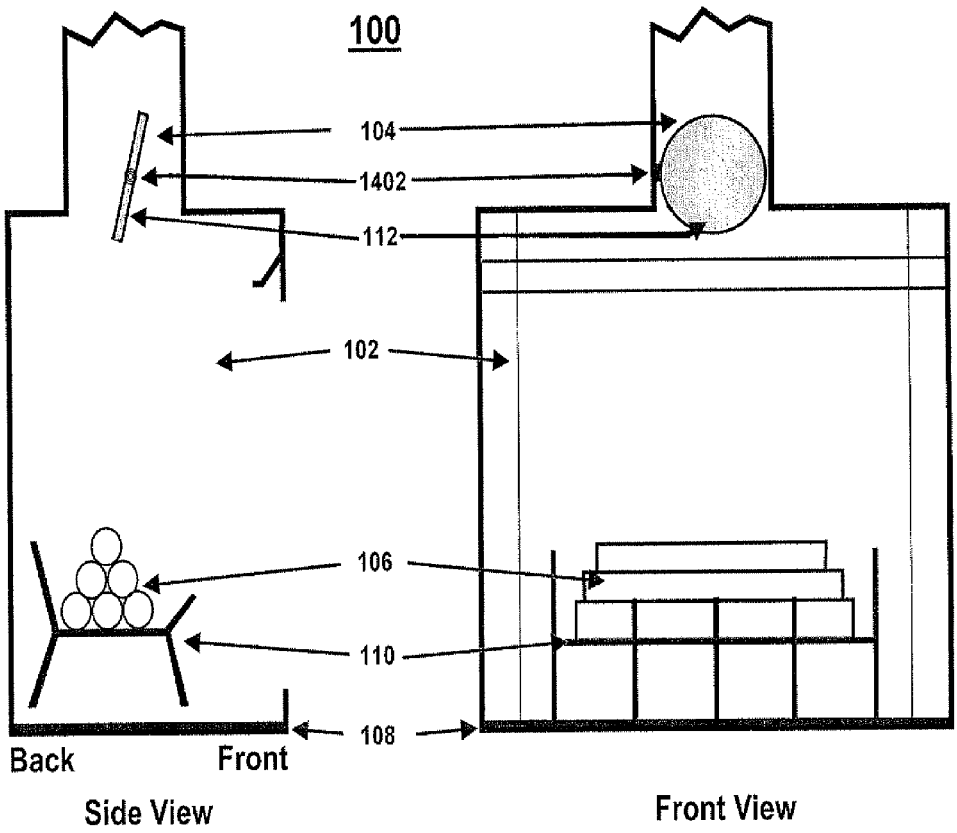
FIG. 14 illustrates a media in an open position within a flue from a side and front view.
Figure 15:
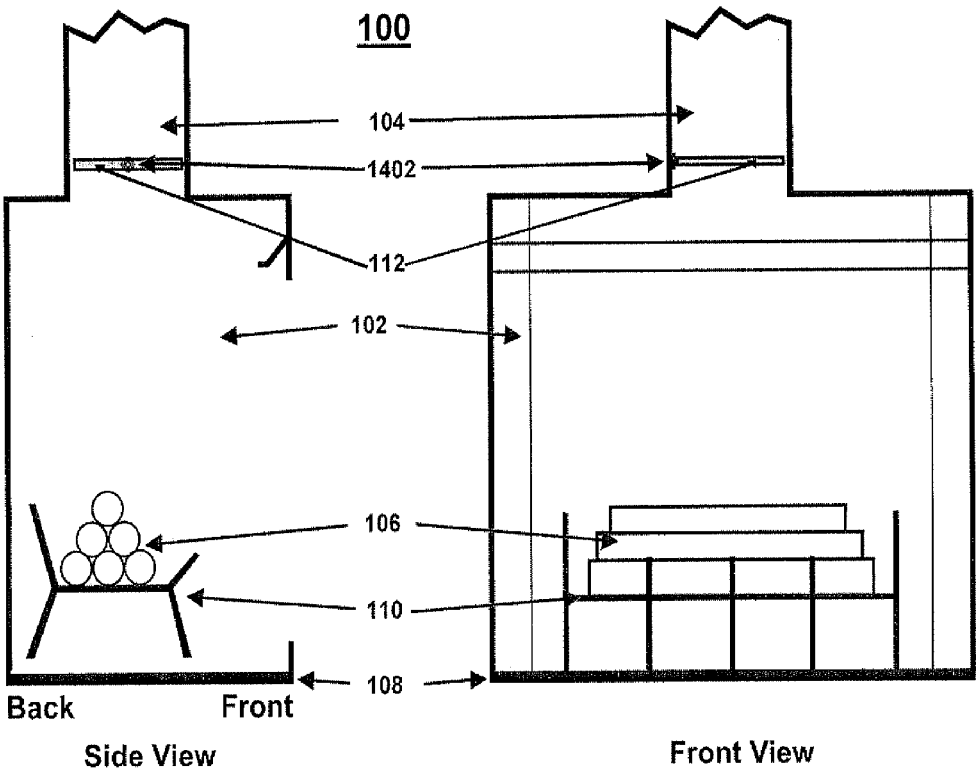
FIG. 15 illustrates a media in an closed position within a flue from a side and front view.

In another embodiment, as shown in FIG. 14, the media 112 is positioned inside the flue 104, directly above the firebox 102. Because of the position of the media 112 within the flue 104, it inevitably causes some, although minor, resistance to the fireplace 100 draft during periods of low exhaust flow, such as when the fire is first starting up. To minimize the amount of resistance to the fireplace draft during periods of low exhaust flow, and maximize the amount of particulate conversion during high exhaust flow, the media 112 is mounted in a support structure (not shown) that is attached to a bimetallic coil 1402. The bimetallic coil 1402 comprises two strips of different metals, typically steel and copper, that are bonded together. Because the metals have different expansion rates, temperature changes cause the metals to expand or contract at different rates, causing the bonded strips to coil or uncoil. During low exhaust flow periods, which correspond to exhaust temperatures below 300° F., the bimetallic coil 1402 rotates the media 112 to a full open position. During periods of high exhaust flow, in one embodiment when the temperature is greater than 700° F., the bimetallic coil rotates the media 112 to a full closed position, as depicted in FIG. 15.

In some embodiments of the invention, when the temperature of the fireplace 100 is neither high nor low, the bimetallic coil maintains the media 112 in intermediate positions within the fireplace flue 104. Such intermediate positions result in the media 112 being partially closed such that some exhaust flows through the media 112, while some exhaust freely flows around the media 112. The exact intermediate position of the media 112 depends on the temperature of the fireplace, with hotter temperatures, such as 500° F. resulting in the media 112 being more closed, while cooler temperatures such as 350° F. resulting in the media 112 being more open.

In another embodiment of the invention (not shown), rather than rotating the media 112 within the flue 104, a bypass route is provided for low temperature and inertia exhaust. For instance, in some embodiments the diameter of the media 112 is smaller than the diameter of the flue 104. Thus, low temperature exhaust will flow around the media 112 and up the flue 104 via the gap between the media 112 and the flue 104.

A side effect of cleaning the exhaust stream of the majority of the harmful pollutants is that the interior of the chimney is kept much cleaner thereby reducing the probability of a chimney fire.

Figure 16:
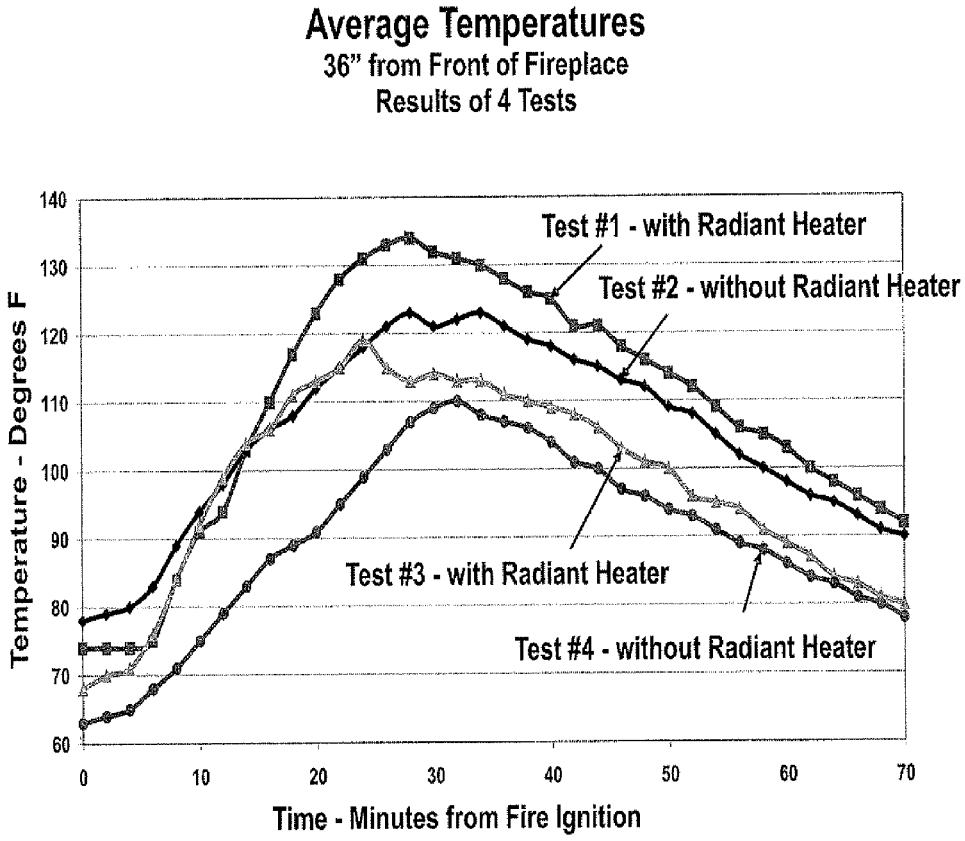
FIG. 16 displays the average recorded temperature of four burns from the front of a fireplace.

FIG. 16 displays the average recorded temperature 36 inches directly outside of the opening of the firebox 100 of the fireplace during four tests. For each test, a controlled burn was initiated which lasted slightly more than 70 minutes. Tests 1 and 3 utilize the media 112 (referred to as the "radiant heater") according to some of the embodiments of the invention, while tests 2 and 4 did not. Test 1 utilized the same testing environment as test 2, while test 3 utilized the same testing environment as test 4. The differences in the environments between the two test groups consisted only of the ambient temperatures and the temperatures of the fireplace at the initiation of the test. All other conditions were held constant between all tests. As is apparent, the tests in which the media 112 was utilized resulted in a higher recorded temperature during essentially all stages of the controlled burn.

Figure 17:
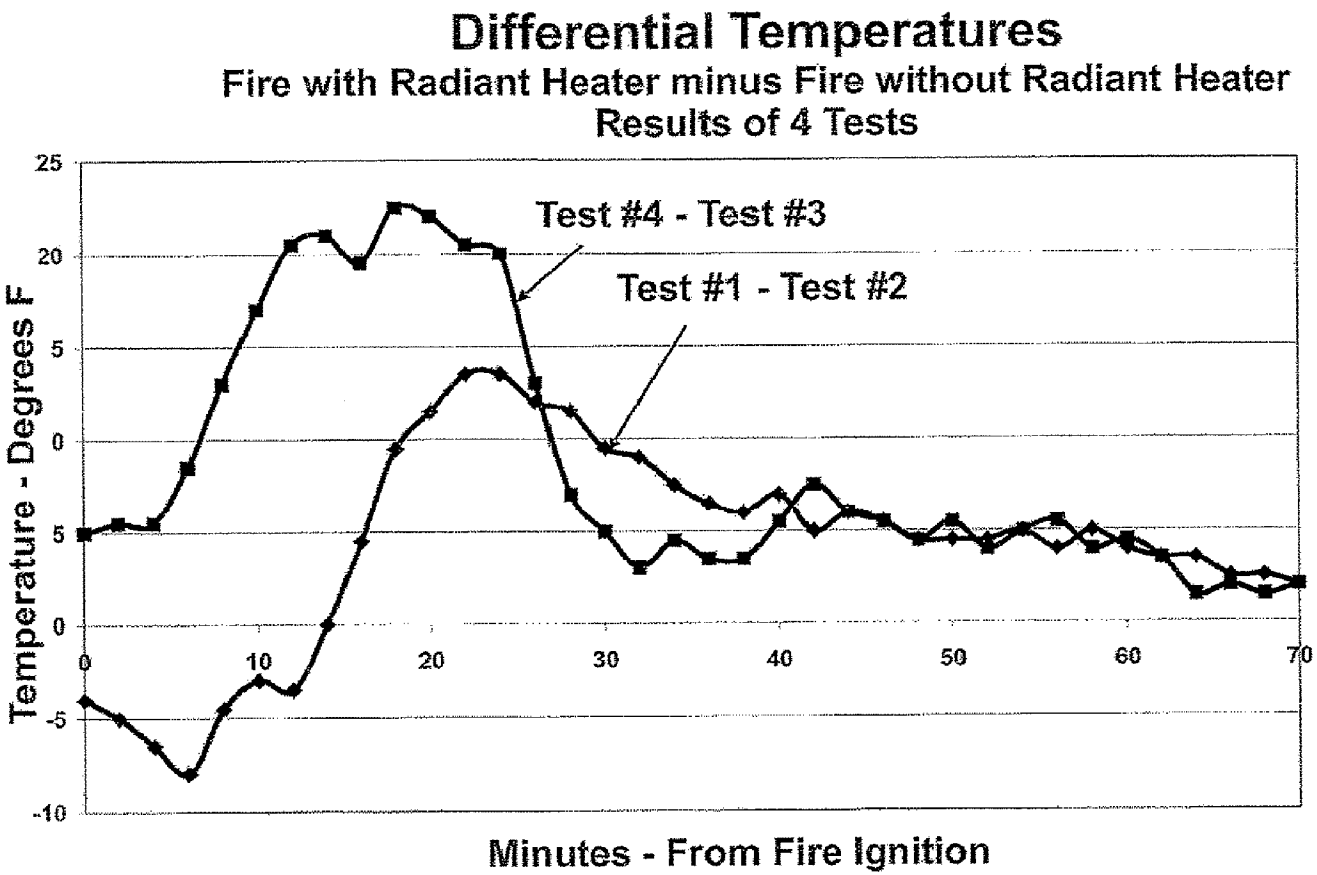
FIG. 17 displays the differential temperatures between tests 1 and 2 and tests 3 and 4 as depicted in FIG. 16.

Referring now to FIG. 17, displayed are the differential temperatures between tests 1 and 2 and tests 3 and 4. The differential temperature for each pair of tests was calculated by subtracting the temperatures measured during the tests without the media 112 installed from the temperature measured with the media 112 installed. Utilizing the media 112, in one embodiment, resulted in an additional 2° F. to 14° F. increase in temperature outside of the fireplace 100 over the course of the burn between the first and second tests, and in an additional 2° F. to 23° F. increase in temperature over the course of the burn between the third and fourth tests.

Figure 18:
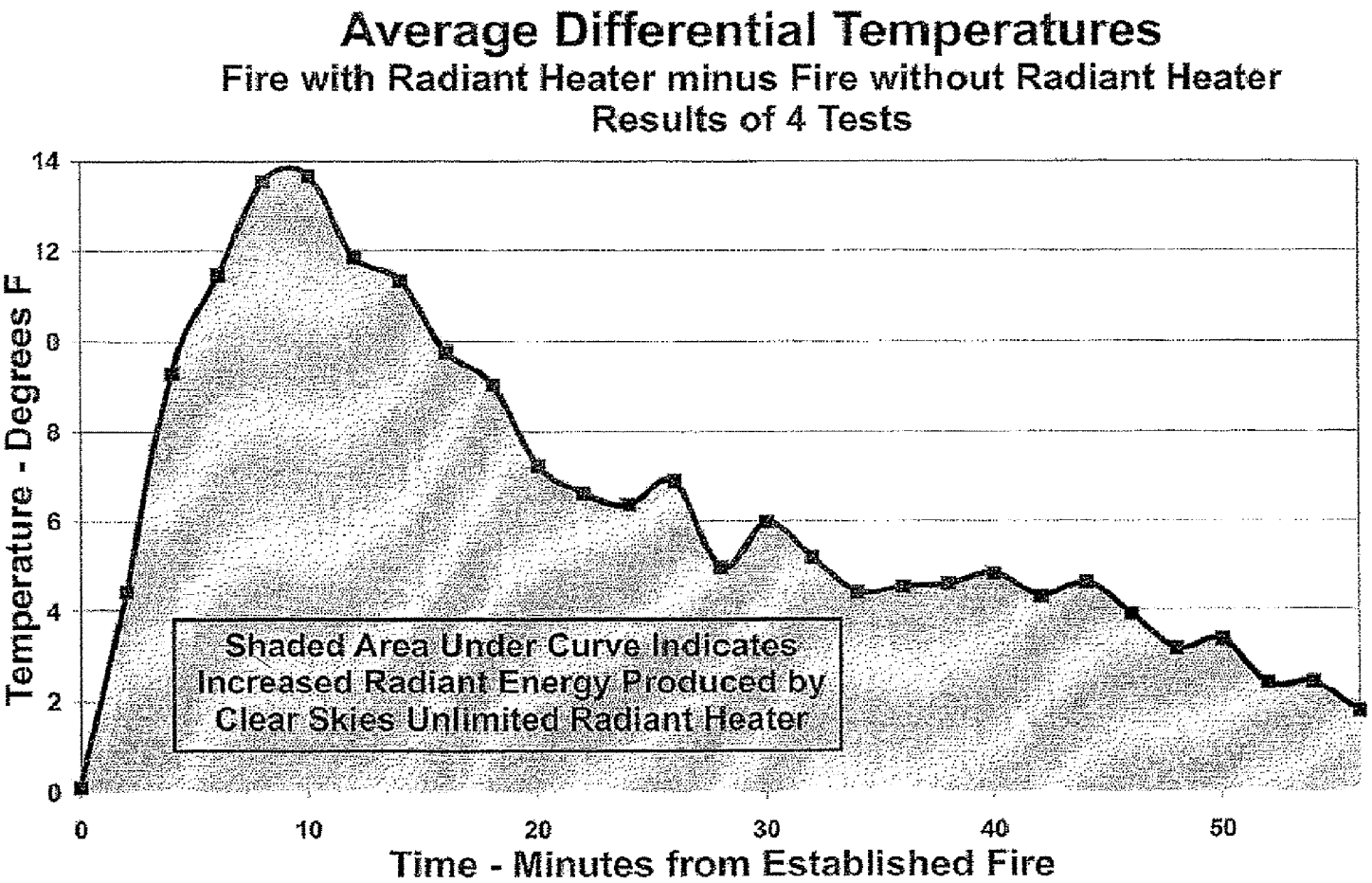
FIG. 18 depicts the averaged differential temperature from all four tests of FIG. 16.

Referring now to FIG. 18, displayed is the averaged differential temperature from all four tests. As is apparent, over all four tests, using the media 112 resulted in an average increase in temperature between 2° F. and 14° F. over the entire period of the burn. The shaded area under the curve is directly related to the amount of increased radiant energy transmitted from the firebox 100.

The apparatuses and methods for increasing the heat efficiency of a fire in a firebox while reducing emissions as described above can be used not only with new fireboxes but also to retrofit existing fireboxes.

While the invention herein disclosed has been described by means of specific embodiments and applications thereof, other modifications, variations, and arrangements of the present invention may be made in accordance with the above teachings other than as specifically described to practice the invention within the spirit and scope defined by the following claims.

What is claimed is:

1. A fuel combustion emission reduction apparatus comprising:

a firebox;

a casing assembly comprising a catalyst-coated media, said catalyst-coated media disposed between a fuel combustion source and a flue, wherein the fuel combustion source is disposed within said firebox, and wherein said catalyst-coated media reduces emissions associated with fuel combustion when contacted with combustion exhaust; and said catalyst-coated media positioned in a position that permits low fluid flow to avoid contacting said catalyst-coated media and to thus flow out of said firebox unimpeded by said media.

2. The apparatus of claim 1 wherein said casing assembly is positioned substantially over the fuel combustion source and wherein said casing assembly is substantially non-parallel to a flow of the combustion exhaust.

3. The apparatus of claim 1 wherein said casing assembly is positioned substantially over the fuel combustion source and wherein said casing assembly is substantially non-perpendicular to a flow of the combustion exhaust.

4. The apparatus of claim 1 wherein said casing assembly is positioned substantially over the fuel combustion source and wherein said casing assembly is substantially non-parallel and substantially non-perpendicular to a flow of the combustion exhaust.

5. The apparatus of claim 1 wherein said casing assembly is positioned substantially over the fuel combustion source at an optimal angle to facilitate transfer of infrared energy released by combustion of fuel out of said firebox.

6. The apparatus of claim 1 wherein said catalyst-coated media reduces emissions by an element selected from the list consisting of reducing particulates in the exhaust, reducing volatile organic compounds in the exhaust, reducing carbon monoxide in the exhaust, and a combination thereof.

7. The apparatus of claim 1 wherein said casing assembly is detachably-fastened to at least one interior surface of said firebox.

8. The apparatus of claim 1 wherein said casing assembly comprises at least one support structure.

9. The apparatus of claim 8 wherein said support structure comprises at least one substantially vertical element comprising a first end in contact with a hearth of said firebox and a second end joined to said casing assembly.

10. The apparatus of claim 9 wherein said support structure comprises at least one substantially horizontal element joined to said second end wherein said substantially horizontal element further supports said casing assembly.

11. The apparatus of claim 8 wherein said support structure is positioned substantially at a back of an interior surface of said firebox.

12. The apparatus of claim 8 wherein said support structure is disposed substantially on one or more side portions of an interior surface of said firebox.

13. The apparatus of claim 8 wherein said support structure comprises adjusting elements, said casing assembly adjustably positionable in relation to the combustion source with said adjusting elements.

14. The apparatus of claim 8 wherein said support structure is removably positionable within an interior of said firebox.

15. The apparatus of claim 14 wherein said support structure further comprises a removing mechanism, said mechanism comprising an element selected from the group consisting of a fastener, a spring-loaded rod, a mounting bracket, an adhesive, and a combination thereof.

16. The apparatus of claim 1 wherein said casing assembly is disposed substantially non-parallel to a flow of combustion emissions.

17. The apparatus of claim 1 wherein said catalyst-coated media comprises at least one panel.

18. The apparatus of claim 17 wherein said casing assembly further comprises casing assembly adjusting elements which are adjustable for a size of said casing assembly in relation to a number and size of said at least one panel.

19. The apparatus of claim 17 wherein said at least one panel comprises an element selected from the list consisting of an open-celled structure, and a reticulated structure.

20. The apparatus of claim 1 wherein said catalyst-coated media comprises a material selected from the list consisting of a metal and a ceramic.

21. The apparatus of claim 1 further comprising a heating element attached to said catalyst-coated media.

22. The apparatus of claim 21 wherein said heating element comprises an electrical heating element.

23. The apparatus of claim 1 wherein said catalyst-coated media comprises pores having a diameter of between approximately 0.02 inches to approximately 0.33 inches.

24. A method for retrofitting a firebox with an emission reduction system, the method comprising:

providing a firebox;

providing an emission reduction system comprising:

providing a casing assembly comprising a catalyst-coated media; and providing a support structure supporting the casing assembly;

positioning the casing assembly between a fuel combustion source and a flue by disposing the support structure within the firebox;

adjustably positioning the casing assembly using a motor; and burning the fuel combustion source to create a fire within the firebox, wherein the catalyst-coated media reduces emissions associated with fuel combustion when contacted with fuel combustion emissions.

25. The method of claim 24 further comprising:

determining the approximate dimensions of an interior space of the firebox; and modifying dimensions of the emission reduction system to correspond to the approximate dimensions of the firebox.

26. The method of claim 24 wherein the casing assembly is adjustably positioned substantially non-perpendicular to a flow of the fuel combustion emissions.

27. The method of claim 24 further comprising adjusting an angle of the casing assembly to maximize heat energy projected into a room.

28. The method of claim 24 further comprising providing a thermometer and adjusting the casing assembly relative to a temperature.

29. The method of claim 24 wherein the support structure comprises adjusting elements for adjustably positioning the casing assembly between the fuel combustion source and the flue.

30. The method claim 24 wherein the catalyst-coated media is disposed in a support structure attached to a bimetallic coil comprising at least two strips of different material.

31. The method of claim 24 further comprising disposing the catalyst-coated media on at least one panel.

32. The method claim 31 wherein the catalyst-coated media coats approximately all internal surfaces of the at least one panel.

33. The method of claim 31 wherein the at least one panel comprises an open-celled structure.

34. The method of claim 31 wherein the at least one panel comprises a reticulated structure.

35. The method of claim 24 wherein providing an emission reduction system comprises providing at a support structure having at least one approximately vertical element comprising a first end in contact with a hearth of the firebox and a second end joined to the casing assembly.

36. The method of claim 24 wherein the support structure comprises at least one approximately horizontal element attached to the catalyst-coated media and attached to at least one interior wall of the firebox.

37. The method of claim 24 wherein providing a support structure comprises providing at least one substantially horizontal element attached to at least one interior wall of the firebox and attached to at least one cantilevered arm supporting the media.

38. The method of claim 24 wherein providing a support structure comprises providing a freestanding support structure which is removable from the firebox.

39. The method of claim 24 wherein providing a support structure comprises providing a size-adjustable support structure.

40. The method of claim 24 wherein providing a support structure comprises providing spring-loaded rods which exert friction on at least one interior wall of the firebox and securing the support structure in place within the firebox.

41. The method of claim 24 wherein the catalyst-coated media comprises a material selected from the group consisting of a metal and a ceramic.

42. The method of claim 24 wherein the catalyst-coated media comprises a shape and size comparable to a size and shape of the firebox.

43. The method of claim 24 wherein the casing assembly comprises at least two sections to accommodate a damper handle.

44. The method of claim 24 further comprising attaching the catalyst-coated media to a heating element to increase the temperature of the catalyst-coated media to an efficient operating temperature.

45. The method of claim 44 wherein the heating element is provided as an electrical heating element.

46. The method of claim 45 wherein the electrical heating element is a switch-activated electrical source.

47. The method of claim 24 wherein the electrical heating element is a thermometer-activated heating element.

48. The method of claim 24 wherein the casing assembly comprises a shape and size comparable to a size and shape of the flue.

49. The method of claim 24 wherein the catalyst-coated media comprises pores.

50. The method of claim 49 wherein the pores are between approximately 0.02 inches to approximately 0.33 inches in diameter.

51. The method of claim 49 wherein the pores provide a back pressure to fluid flow within the firebox thereby causing fuel combustion gas emission to flow through the media to the flue of the firebox.

* * * * *